United States Patent [19]

Mayer et al.

[11] 4,438,624

[45] Mar. 27, 1984

[54] OVERHUNG MOUNTED ROTATABLE CENTERING SPINDLE

[75] Inventors: Walter Mayer; Stephan Wittmann, both of Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 382,964

[22] Filed: May 28, 1982

[30] Foreign Application Priority Data

Jun. 2, 1981 [DE] Fed. Rep. of Germany ..... 3121759

[51] Int. Cl.[3] ..... D01H 15/00; B65H 57/00; B65H 69/00

[52] U.S. Cl. ..... 57/352; 57/261; 57/263

[58] Field of Search ..... 57/1, 22, 352, 261, 57/263, 269, 278, 279, 280, 361; 242/43 R

[56] References Cited

U.S. PATENT DOCUMENTS

| | | | |
|---|---|---|---|
| 3,169,714 | 2/1965 | Schippers | 242/43 X |
| 3,198,446 | 8/1965 | Furst et al. | 57/261 X |
| 3,248,063 | 4/1966 | Sheldon et al. | 242/43 X |
| 3,599,416 | 8/1971 | Reuter et al. | 57/352 X |
| 3,739,566 | 6/1973 | Smith | 57/352 X |
| 4,223,517 | 9/1980 | Hugges et al. | 57/261 |

*Primary Examiner*—Donald Watkins
*Attorney, Agent, or Firm*—Julian W. Dority

[57] ABSTRACT

An overhung mounted rotatable centering spindle (5) for centering a yarn (1) at an open-end spinning location is disclosed having a central groove (52) into which threaded grooves (500, 510) run together oppositely from both sides. The direction of rotation of the centering spindle (5) is reversible. Both threaded grooves have different core diameters ($d_1$, $d_2$), the smaller core diameter ($d_2$) being towards the free end of the centering spindle (5) so that the yarn is immediately and with certainty ejected from the free end of the spindle during reverse rotation.

5 Claims, 3 Drawing Figures

OVERHUNG MOUNTED ROTATABLE CENTERING SPINDLE

BACKGROUND OF THE INVENTION

The present invention relates to a rotatable centering spindle for centering a yarn having a central peripheral groove into which open threaded grooves run together oppositely from both sides.

It is known to provide a centering spindle of this kind on open-end spinning machines. The spindle can be lowered onto the yarn extending from the bobbin to the mouth of a suction tube and is driven at the same time in a direction such that the opposed threaded grooves forward the yarn, independently of its initial position, into the central peripheral groove. In this position, the yarn is located in such a position that it is grasped by a pivotable feeder and can be fed to an auxiliary roll pair of a piecing-up carriage. The yarn must be held back by a roll located in the immediate neighborhood of the centering spindle so that the centering spindle can be lifted from the yarn after completed centering of the yarn and its being taken over by the auxiliary roll pair. Otherwise the danger that the yarn could again be entrained when the centering spindle executes a pivoting-away motion would exist because of the potentially oblique course of the yarn towards the centering spindle, whereby yarn breaks and the like could arise.

The object of the present invention is to construct a centering spindle of the kind stated such that after completed centering of the yarn its certain release is insured in a simple manner.

SUMMARY OF THE INVENTION

This problem is solved according to the invention in that the direction of rotation of the centering spindle is reversible and that the two threaded grooves have different core diameters, the smaller core diameter being on and towards the free end of the centering spindle. If the centering spindle is driven in a first direction of rotation, the yarn is fed conventionally to the central peripheral groove and centered independently of the location of the yarn at initiation of contact between the centering spindle and the yarn. The yarn extending from a stationary yarn guide to the centering spindle is precisely set in its path. Operations for which the fixed yarn course is a precondition can then be carried out.

In order to remove the centering spindle from the yarn without disturbing the course of the yarn, two threaded grooves are provided which run together having different core diameters. The smaller core diameter is located, with respect to the central peripheral groove, on the side of the centering spindle facing the free end of this spindle. On reversal of the direction of rotation of the centering spindle, the yarn is assured of arriving in the threaded groove with the smaller core diameter. This threaded groove forwards the yarn towards the free end of the centering spindle and ejects it there. The centering spindle can then be brought into an inoperative position with out detriment to the yarn, which it no longer contacts.

In order to achieve as rapid as possible an ejection of the yarn from the centering spindle on the reversal of direction of rotation, the threaded groove towards the free end extends into the central peripheral groove and has a smaller core diameter than this peripheral groove.

In this manner, the yarn arrives immediately and with certainty in the threaded groove effecting yarn ejection.

It has been found to be disadvantageous for the threaded grooves to be too deep since they will have a greater region of contact with the yarn while it is being centered by the sidewalls of the threaded groove. This creates increased friction and acts disadvantageously on the yarn and its appearance. In order to avoid this disadvantage, the centering spindle has a smaller external diameter on the side towards its free end than at its side remote from the free end.

Centering spindles according to the invention are conceivably simple in construction and control and are manifold in their possibilities of application. Thus, a feeder can, for example, be associated with the centering spindle and feed the yarn to an auxiliary roll pair of a piecing-up carriage. However, the centering spindle can also be put in place of two pivotable centering yokes which establish the course of the yarn with respect to a knotter which can move into the course of the yarn (DE-PS 2,758,064).

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
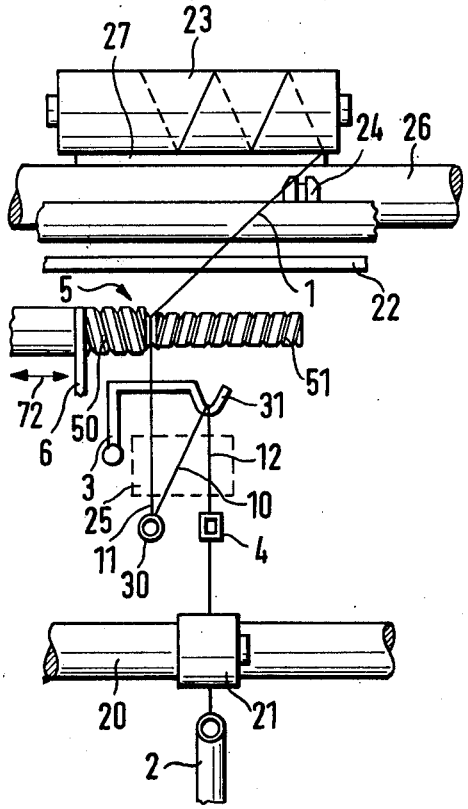
FIG. 1 is a schematic view illustrating an open-end spinning place and a centering spindle constructed according to the invention in a front view.

For simplicity, the object of the invention is to be explained below in relation to an open-end spinning position according to FIG. 4 of DE-PS 2,758,064.

A yarn 1 being conventionally produced in an open-end spinning element (not shown), is drawn through a takeoff tube 2 by means of takeoff rolls 20 and 21. The yarn is then fed via a yarn tension equalizing yoke 22 to a bobbin 23 driven by a drive shaft 26. The yarn 1 is picked up by a traversing yarn guide 24 and wound upon bobbin 23. A bobbin support element 27 lifts the bobbin 23 from the drive shaft 26 to terminate the drive.

In order to be able to eliminate piecings arising during piecing-up and to replace them with knots, the yarn is brought into an N-shaped course with two parallel sections 11 and 12 and an oblique connecting section 10 in its path between the takeoff rolls 20 and 21 and the bobbin 23. A conventional knotter 25 travels along the machine and is movable from the observation side towards the machine. The knotter is constructed such that during knotting it holds the oblique yarn connecting section 10, between the two parallel yarn sections 11 and 12, out of the working region of the knotter.

The yarn 1 is held in its N-shaped course by two yarn guides 30 and 31. The yarn guide 30 is constructed as a suction nozzle while the yarn guide 31 is arranged at the end of a pivotable lever 3. The function of guide 31 is to bring the yarn 1 out of its straight course between the takeoff rollers 20 and 21 and the yarn guide 30 into the N-shaped course. A further suction nozzle 4 is located between the takeoff rolls 20 and 21 and the knotter 25 located in the working position.

The yarn section 12 is fixed by the takeoff rolls 20 and 21 and by the yarn guide 31. The yarn section 11 is fixed parallel to the yarn section 12 by the yarn guide 30, constructed as a suction nozzle and a centering spindle 5 according to the invention.

The centering spindle 5 is seated on a holder 6 which can bring the centering spindle 5 into or out of the normal yarn path by means of a drive (not shown). Since such drives (pivoting or stroke drives, possibly with the insertion of curve guides) are known and common, description of such a drive is omitted here.

The holder 6 carries a motor 60, which is connected via control connections (not shown) with a suitable control device which controls the running time and direction of rotation of the motor 60 and hence spindle as is well known in the art.

The centering spindle 5 has two longitudinal section 50 and 51 which are separated from each other by a peripheral groove 52. Threaded grooves, 500 and 510 respectively, are formed in the two longitudinal sections 50 and 51 and open into peripheral groove 52. The longitudinal section 50 with the threaded groove 500 on a side towards the motor 60 has a greater core diameter $d_1$ than the longitudinal section 51 with the threaded groove 510 (core diameter $d_2$). The two threaded grooves 500 and 510 are constructed opposed, so that on a given rotation of the centering spindle 5 the yarn 1 is fed to the peripheral groove 52 from either section. In the embodiment of the invention shown in FIG. 3, the threaded groove 510 extends into the peripheral groove 52 and has a core diameter $d_2$ which is smaller than the diameter $d_3$ of the peripheral groove 52. In the embodiment shown, the external diameter $D_1$ of the longitudinal section 50 is greater than the external diameter $D_2$ of the longitudinal section 51 whereby the depth of the grooves of the two sections are the same.

OPERATION

When, with the apparatus shown, a yarn break or drop in yarn tension otherwise produced takes place, this is signalled by a yarn monitor (not shown) and the bobbin support element 27 is pushed by a drive (not shown) under the bobbin 23, so that the bobbin is separated from its drive shaft 26 and stopped. The operator now brings the centering spindle 5 out of its inoperative position outside the normal yarn path 1' into the operation position shown in a suitable manner (by hand or automatically by actuation of a switch) through a motion along the double arrow 71. The operator then lifts the bobbin 23 from the bobbin support element 27, finds the yarn end and pulls a sufficient yarn length from the bobbin for piecing-up. This yarn length may be made exact for piecing by cutting it. The corrected yarn end for piecing is now introduced into the takeoff tube 2. Fiber feed is conventionally started in the spinning element. The yarn 1 is then pieced together in the spinning element with yarn being newly spun. The yarn 1 is inserted into the nip of takeoff rolls 20, 21. The yarn 1 is drawn off by the takeoff rolls and arrives in the suction region of the yarn guide 30 which is constructed as a suction nozzle. The yarn is sucked into the nozzle as it is drawn off. At the same time the piecing place in the yarn 1 is also sucked away.

Figure 3:
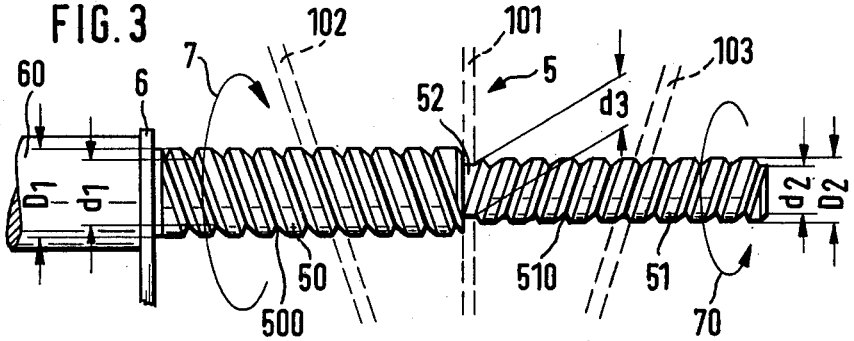
FIG. 3 is an elevation illustrating a centering spindle constructed according to the invention.

The knotter 25 is brought to the spinning position and stopped there in a conventional operation. By conventional means, not shown, the knotter 25 switches on the motor 60 of the centering spindle 5. The yarn 1 lying against the centering spindle 5 is brought to a centering position 101 independently of its initial position of contact with the spindle. Initially, the yarn 1 extends to the bobbin 23 and may assume an oblique position (with reference to FIG. 1) to the right or left. Three initial positions of the yarn 1 are shown in FIG. 3, namely, a left oblique position 102, a right oblique position 103, and a middle position 101. When switched on, motor 60 rotates the centering spindle 5 in the direction of the arrow 7, and the yarn 1 is moved towards the peripheral groove 52. The yarn section 11 between the yarn guide 30, constructed as a suction nozzle, and the peripheral groove 52 is thus brought into a defined position. A necessary deflection of the yarn extending to one end of the bobbin 23 results at the peripheral groove 52 of the centering spindle. After a sufficient time for bringing the yarn 1 into the peripheral groove 52 with certainty, the motor 60 is stopped.

The lever 3 and yarn guide 31 are likewise conventionally pivoted out from the knotter 25 so that the yarn sections 11 and 12 are positioned to form an N-shaped course of the yarn with connecting section 10. The knotter 25 can now conventionally carry out the knotting process while yarn from rolls 20, 21 is immobilized by being intermediately stored in the suction nozzle 4 in the region of the knotter 25. The yarn connecting section 10 is severed by the knotter and carried away by the suction nozzle forming the yarn guide 30.

Figure 2:
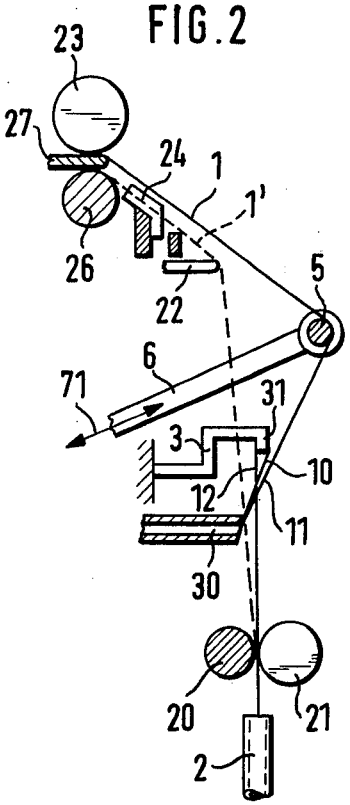
FIG. 2 is a schematic side view of the spinning place and centering spindle shown in FIG. 1.

After knotting, the bobbin support element 27 under the bobbin is pulled away, so that bobbin 23 is again driven by the drive shaft 26. Simultaneously, the centering spindle 5 is rotated in a reverse direction of the arrow 70 by switching on the motor 60. With this rotation, the yarn 1 arrives in the threaded groove 510 extending from the peripheral groove 52 and is thus transported through the threaded groove 510 out of the peripheral groove 52 to the free end of the centering spindle 52 and is there ejected. The yarn 1 is thus delivered in the yarn path 1' (FIG. 2). The centering spindle 5 can now be brought back into its inoperative position (referring to FIG. 2, left of the yarn path 1') by a combined motion along the double arrows 72 and 71.

While the yarn traverses the longitudinal section 51 due to the rotation of the centering spindle 5, the yarn 1 is wound up on the spindle 23, which is already rotating again. The yarn 1 is thus prevented from entering the yarn guide 24 by the centering spindle and the traversing yarn guide does not pickup and wind the yarn on the bobbin 23. However, since the yarn 1 is wound and moved along the bobbin 23 by the rotating centering spindle 5, the yarn 1 is not wound up at a single place on the bobbin 23. Centering spindle 5 thus takes over the function of an auxiliary traversing guide (even if only in one direction).

In the embodiment described, the threaded groove 510 possesses a core diameter $d_2$ which is smaller than the diameter $d_3$ of the central peripheral groove 52 of the centering spindle 52. In this way an immediate takeover of the yarn 1 by the threaded groove 510 occurs on rotation of the centering spindle 5 in the direction of the arrow 70, while this transfer does not always take place immediately when the diameters $d_2$ and $d_3$ are equal. Thus, if a particularly rapid release of the yarn 1 by the centering spindle 1 is desired, this is achieved in a simple manner by selection of a core diameter $d_2$ which is smaller than the diameter $d_3$.

When it is also not absolutely necessary to choose the external diameters $D_1$ and $D_2$ of different magnitudes, it has been found to be advantageous for the depth of the threaded grooves 500 and 510 to be equal. The contact region of the threaded grooves 500 and 510 should not be greater than necessary in order not to impair the appearance of the yarn 1 by excessive friction.

The inclination of the threaded grooves 500 and 510 is suitably selected such that they substantially correspond with the initial position of the yarn 1 in the oblique positions 102 and 103. If the yarn 1 abuts the underside of the centering spindle 5, threaded grooves are thus required which have an inclination that is the other way around as compared with the embodiment shown. In this case, the yarn, from the observer's side, abuts on the upper side of the centering spindle 5.

While centering spindle 5 has been described above in the example of an open-end spinning position at which a knotting process is carried out by means of a traveling knotter 25, other applications are also possible. Thus, the centering spindle 5 can be brought into the path of a yarn 1 which extends from the bobbin 23 to a pivotable suction nozzle which has previously taken up the yarn on the bobbin 23 and has drawn it away from there. This suction nozzle (not shown) is as a rule a component of an automatic piecer. The yarn 1 must here finally be introduced again, by means of several elements, into the takeoff tube 2. So that the yarn is seized with certainty by the individual elements, it is necessary that the yarn 1 assumes a defined position and that the oblique positions with respect to such elements are eliminated. This occurs by the centering spindle 5 constructed according to the invention which is either brought into the yarn path between the bobbin 23 and the suction nozzle, or to which the yarn 1 is brought during the constant sucking away from the bobbin 23 by the correspondingly constructed suction nozzle.

The "elements" mentioned can be movable elements such as feeders, etc.; however, the takeoff rolls 20, 21 can also be concerned, and the yarn 1 can be better fed to their nip line through a defined position. Combinations of several elements of this type are also possible.

The bobbin 23 can be stopped or also can be driven via its drive shaft 26 or also by an individual drive (not shown).

The centering spindle 5 can be arranged stationary at each spinning position, or can be arranged on a device which can travel along the machine. It is space-saving and can itself be applied where pivotable yarn guides cannot be used because of reasons of space.

While a preferred embodiment of the invention has been described using specific terms, such description is for illustrative purposes only, and it is to be understood that changes and variations may be made without departing from the spirit or scope of the following claims.

What is claimed is:

1. A centering spindle for centering a yarn at an open-end spinning position and the like of the type having a central peripheral groove into which open threaded grooves run together oppositely from both sides, comprising:

a first longitudinal section of said grooves running into said central groove from one side thereof;

a second longitudinal section of said grooves running into said central groove from a second side thereof and extending away therefrom to a free end of said spindle;

said centering spindle being reversibly rotatable so that a yarn engaged thereby travels from said central groove to said free end and is there ejected from said spindle; and said threaded grooves of said first and second sections having different core diameters.

2. The centering spindle according to claim 1 wherein the threaded groove of said second section has a smaller core diameter than said peripheral groove.

3. The centering spindle according to claim 1 or 2, wherein said threaded groove of said second section has a smaller external diameter than the groove of said first section.

4. The centering spindle according to claim 1 or 2, wherein said second section of said spindle has a smaller core diameter than said first section.

5. The centering spindle according to claim 1 wherein said second section ends within the peripheral groove and has a smaller core diameter than said peripheral groove.

* * * * *